US005499710A

United States Patent [19]

Hoffman

[11] Patent Number: 5,499,710

[45] Date of Patent: Mar. 19, 1996

[54] PORTABLE COIN HOLDER AND DISPENSER

[76] Inventor: Charles Hoffman, 12401 SW. 2nd St., Plantation, Fla. 33325

[21] Appl. No.: 311,564

[22] Filed: Sep. 23, 1994

[51] Int. Cl.[6] ..... A45C 11/00

[52] U.S. Cl. ..... 206/0.81; 206/0.83; 453/50

[58] Field of Search ..... 206/0.8, 0.81–0.84, 206/445, 303, 305; 453/39, 50

[56] References Cited

U.S. PATENT DOCUMENTS

| | | | |
|---|---|---|---|
| 986,158 | 3/1911 | Florsheim | 453/50 |
| 1,053,704 | 2/1913 | Broadberry | 206/0.82 |
| 1,465,185 | 8/1923 | Sandberg | 206/0.81 |
| 1,493,482 | 4/1924 | Edelin | 453/50 |
| 2,083,117 | 6/1937 | Cunningham | 206/0.82 |
| 2,147,016 | 2/1939 | Diesing | 453/50 |
| 2,553,257 | 5/1951 | Honeyman | 453/50 |
| 2,569,629 | 10/1951 | Everitt | 453/50 |
| 3,592,204 | 7/1971 | Hernandez | 453/50 |
| 4,951,817 | 8/1990 | Barletta et al. | 206/305 |

FOREIGN PATENT DOCUMENTS

| | | | |
|---|---|---|---|
| 219173 | 1/1958 | Australia | 206/0.8 |
| 2148039 | 5/1985 | United Kingdom | 453/50 |

*Primary Examiner*—Jimmy G. Foster

[57] ABSTRACT

There is disclosed a one piece coin holder having a main flat body, a central obstruction and openings at both ends suitable for insertion or egress of a predetermined number of coins. The open ends define a cavity with a slightly larger diameter than said coin but flexible protrusions are configured at said open ends in such a manner so as to trap said coin per it's diameter. The afore mentioned cavities would also hold said coins in a flat manner employing tabs which extend inward from the upper edge of said cavity walls defining an aperture portion. Said cavities would have dimensions consistent with those needed to hold new coins or ones with worn diameters and/or thickness'. There are also alignment rails Incorporated along the under side to aid in the installation process.

6 Claims, 2 Drawing Sheets

PORTABLE COIN HOLDER AND DISPENSER

BACKGROUND-FIELD OF THE INVENTION

The present invention relates to coin holders and more particularly, to a simple device which may be retrofittable to an electronic pager, for holding a pair of coins of a particular denomination or size which may be quickly received and individually dispensed thereby and will retain such coins when completely or partially filled.

BACKGROUND-DESCRIPTION OF PRIOR ART

A variety of holders and receptacles have been disclosed and used in the past for holding, carrying, and dispensing coins. These include devices which are used only as coin holders such as disclosed, for example, in U.S. Pat. Nos. 682,852, 1,378,277, 2,117,516 and 2,227,191, devices used to hold a combination of items such as coins together with car keys and the like as disclosed in U.S. Pat. Nos. 2,569, 629, 3,473,648 and 4,305,497, and coin holders used in association with pocket books, wallets and the like such as disclosed in U.S. Pat. Nos. 663,016, 1,863,150 and 2,013, 485.

For example in U.S. Pat. No. 5,114,014 the token or coin holder carries the tokens or coins in a longitudinal array. In U.S. Pat. No. 5,01 6,262 the cash caddy holds different sized coins in a hinged holder. In U.S. Pat. No. 5,219,069 the coin holder is chainable and has stackable coin holders. In U.S. Pat. Nos. 4,595,100, 4,541,528, 4,139,093, 4,095,608, 4,049,115, D273,403, D268,219, D262,749, D257,070, D244,060, the coin or token holders are cylindrical for holding a multiple amount of coins or tokens. In U.S. Pat. Nos. D243,494 and D252,775 the coin or token holders are designed for multiple sized coins.

However, there are currently no coin holders available which have been specifically designed to retrofit to an electronic paging device, mainly but not solely, to ensure an individuals ability to use a pay telephone to make a return phone call in response to an incoming page.

SUMMARY OF THE INVENTION

It is accordingly an object of the present Invention to provide a simple device for receiving and dependably holding coins which will enable the ready dispensing of such articles from the holder when needed without undue manipulation by the user and will prevent accidental displacement from the holder when full or partially empty while being carded or used, the device being fabricated so as not to add substantially to the bulk thereof when affixed to the pager.

It is another object of the present invention to provide a simple device which can be economically fabricated for carrying a pair of coins from which such articles can be conveniently dispensed, preferably one at a time, without accidental displacement of items remaining in the holder.

It is a further object of the present invention to provide a simple device which can be readily and economically fabricated as a unitary structure and is capable of readily receiving and carrying an adequate supply of coins to ensure the user's ability to make more than one attempt at achieving the desired result.

In accordance with the present invention there is provided a coin holder which is of a flat configuration made of slightly elastic and flexible material and having two open opposite ends for permitting insertion or egress of a predetermined number of coins of the same denomination, Into or from the holder. The end openings are defined partly by flexible protrusions configured in a manner to be slightly smaller than the cavity which they define. Said cavity is slightly larger than the coin or disc shaped object, so that the latter Is diametrically trapped by said protrusions and frictionally held flat by tabs extending perpendicularly from the upper edge of the cavity walls and parallel to the bottom wall. The upper side of said cavity has an aperture portion relative to said tabs, by which coins being carded may be viewed and manipulated. Preferably, production tolerances should allow coins in either new or worn condition to be held in the same manner, and in the same number. The holder could be made of either transparent or opaque material possessing the necessary flexibility characteristics. The coins are releasable from the holder by simply applying directional pressure on the flat surface of the exposed coin with one's finger tip.

Other objects, features and advantages will be readily apparent from the following detailed description of a preferred embodiment thereof taken in conjunction with the drawings.

BRIEF DESCRIPTION OF THE DRAWINGS

For the purpose of illustrating the invention, there Is shown in the accompanying drawings one embodiment which Is presently preferred; it being understood that the invention Is not intended to be limited to the precise arrangements and Instrumentality's shown.

REFERENCE NUMERALS IN DRAWINGS

Figure 1:
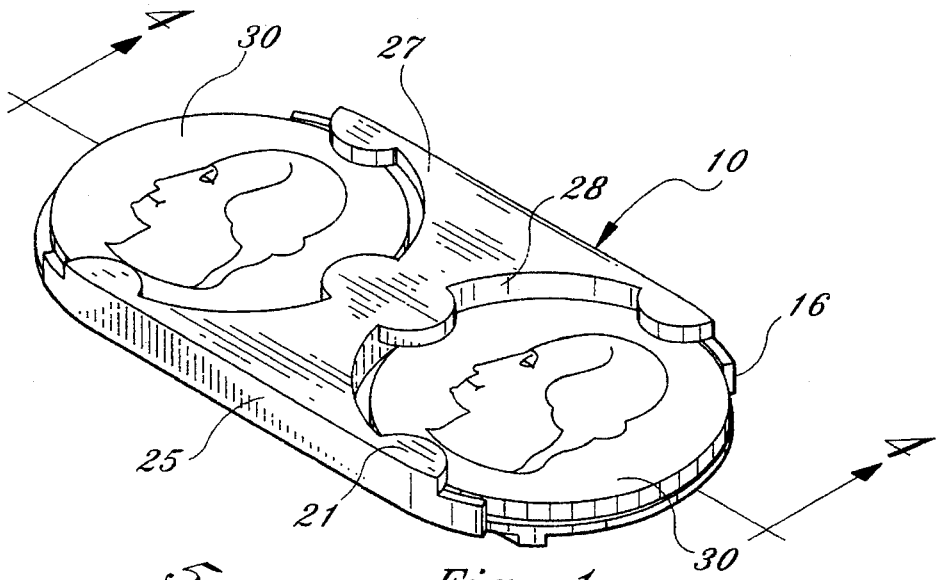
FIG. 1 is a top view in perspective of the coin holder in accordance with the invention with a pair of coins carried thereby.
Figure 2:
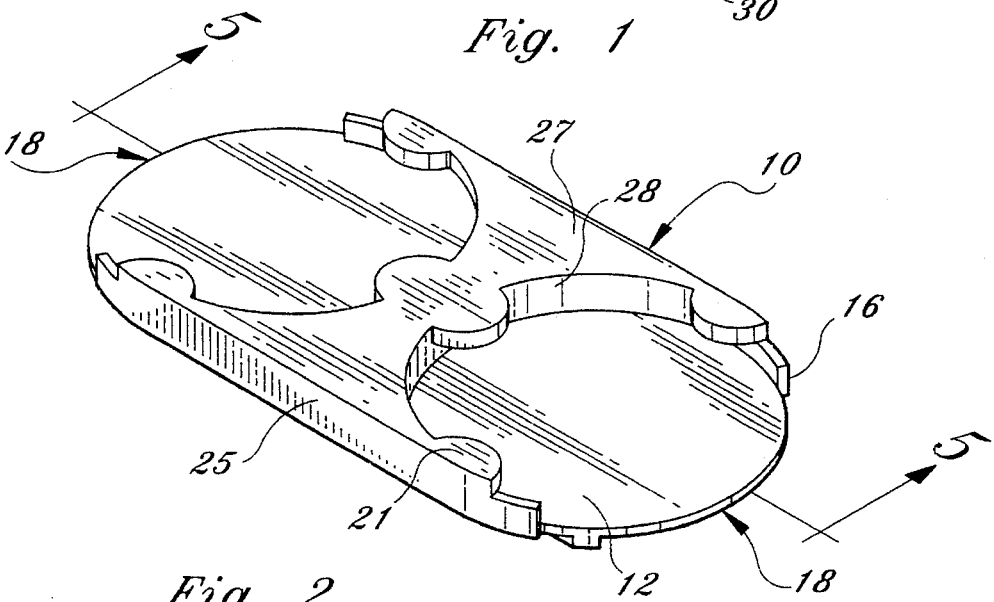
FIG. 2 is a top view in perspective of the coin holder shown in FIG. 1 from which the coins have been dispensed.

| | | | |
|---|---|---|---|
| 10 | coin holder | 12 | coin retaining cavity |
| 14 | central obstruction | 16 | flexible protrusions |
| 18 | open ends | 21 | tabs |
| 23 | bottom | 25 | side walls |
| 26 | alignment rails | 27 | top surface |
| 28 | aperture portion | 30 | coin |

DESCRIPTION OF PREFERRED EMBODIMENT

Referring now to the drawings, where like reference numerals identify like parts, there shown in FIGS. 1 to 6, by way of illustration, but not of limitation, a coin holder in accordance with the invention shown generally as 10.

The coin holder 10 Includes a spaced top surface 27 and bottom wall 23 with spaced side walls 25 and a central obstruction 14 Integral with and connecting the top surface 27 and bottom wall 23 and cooperating therewith to define a coin retaining cavity 12. Both ends 18 of the holder 10 are open to receive coins 30 to be retained therein and through which the coins can be dispensed. Flexible protrusions 16 are configured at the open ends 18 and partially define the coin retaining cavities 12, of which, said open ends 18 are slightly smaller than the full diameter of the coin retaining cavities 12 which also enables holder 10 to trap coin 30 per it's diameter. The coin 30 is also frictionally held fiat by tabs 21 which are parallel to the bottom wall 23 and extend inwards from the edge where the top surface 27 and side walls 25 meet. Two aperture portions 28 are formed in the top surface 27 above the coin retaining cavities 12 and are defined by said tabs 21 and side walls 25. Said aperture portions 28 allow coins 30 to be viewed and manipulated. With respect to installation, there are alignment rails 26 which are parallel to each other, and extend longitudinally on the underside of the bottom wall 23 between the open ends 18. The holder 10 may be fabricated of any suitably strong, substantially rigid plastic material by conventional molding techniques whereby the holder may be integrally formed or the parts there of may be fabricated separately from suitable rigid materials including plastics, metal and the like and then assembled by conventional means.

The inner faces of the top surface 27 and bottom wall 23, side walls 25, flexible protrusions 16, and tabs 21 defining the coin retaining cavity 12 are uniquely constructed and configured to be suitable for dependably retaining a pair of coins 30 therein as well as being adapted for readily receiving and dispensing coins. A pair of coins are retained within the cavities in a longitudinal array and are secured per their diameter by the flexible protrusions 16 as well as being frictionally held fiat by the tabs 21.

Figure 3:
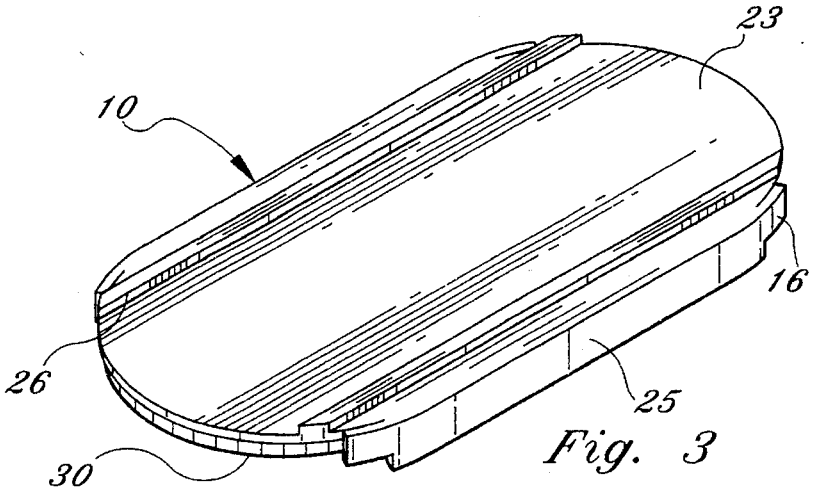
FIG. 3 is a bottom view in perspective of the coin holder shown in FIG. 1.
Figure 4:
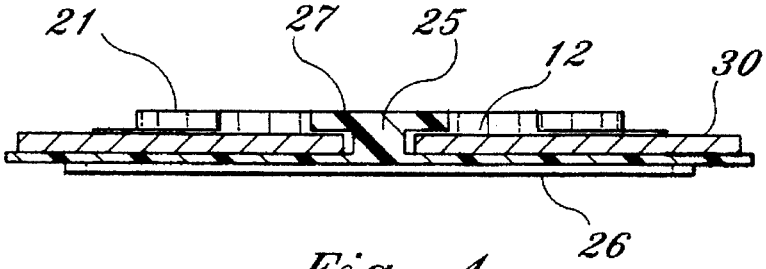
FIG. 4 is a sectional view taken along line 4—4 of FIG. 1.
Figure 5:
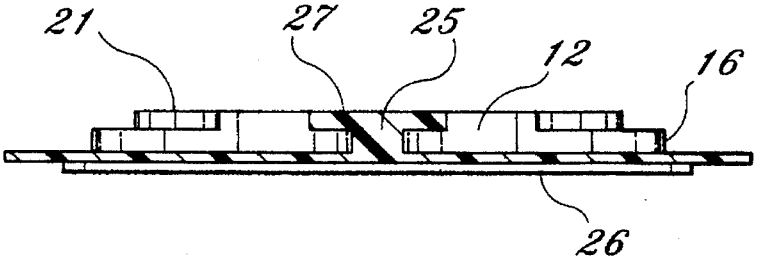
FIG. 5 is a sectional view taken along line 5—5 of FIG. 2.
Figure 6:
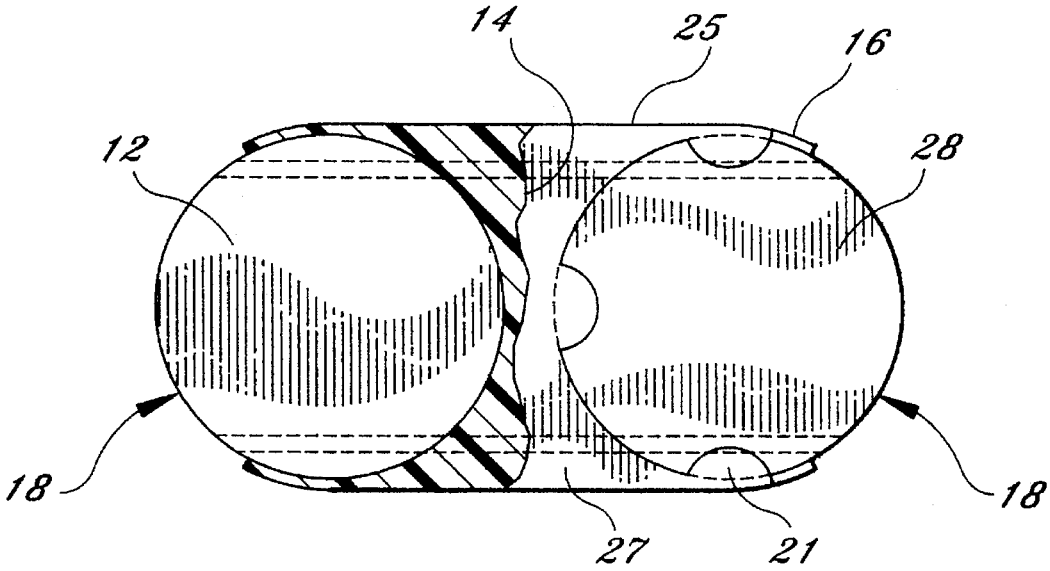
FIG. 6 is a top view In perspective of the coin holder shown in FIG. 2 with tabs and top surface partially removed.

In FIGS. 1, 3 and 4 the coin holder 10 of the invention Is shown as retaining two coins 30 of essentially the same size arranged in a longitudinally fiat manner within the coin retaining cavities 12, both coins being readily viewed through the aperture portion 28 in the top surface 27 of each cavity 12 of holder 10. The pair of coins 30 are positively and effectively retained within the cavity 12 by the virtue of being diametrically trapped within coin retaining cavity 12 by flexible protrusions 16 and frictionally held fiat by tabs 21.

Filling the holder 10 with coins is readily accomplished by inserting one coin through each open end 18 of the holder 10. Removal of the coins is also readily accomplished by applying directional pressure with the tip of ones finger through the aperture portion 28 to the exposed fiat surface of the coins in the amount sufficient to dislodge them endwise through open ends 18. In this way the coins may be dispensed one at a time as needed without displacement of the other coin.

From the foregoing it should be readily apparent to those skilled In the art that the coin holder 10 of the present invention having two retaining chambers in which a pair of coins can be dependably carded without Inadvertent displacement of the coins, and from which the coins can be readily dispensed one at a time and which can be affixed to an electronic pager, provides a device which has a definite purpose and a possible multitude of uses for carrying coins of various sizes and denominations. The term 'coin' used in the description and claims includes not only money coins but tokens, chips, and the like disc shaped pieces.

Having thus described the invention in relation to the drawings hereof, it will be clear that modifications could be made In the preferred embodiment without departing from the sprit of the invention. Accordingly, it is not Intended that the words used to describe the invention be limiting thereof nor should the drawings be considered so. It is intended that the invention be limited only by the scope of the appended claims.

What is claimed is:

1. A coin holder which readily receives, dependably holds, and easily releases coins comprising a substantially rigid body having spaced substantially opposing cavity side walls and an intermediate obstruction, said cavity side walls and said intermediate obstruction each connecting upper tabs and a bottom wall and cooperating with said tabs and bottomwall to define cavities, said intermediate obstruction being located between said cavities, each cavity having a diameter defined by said side walls and said obstruction, each cavity also having open ends with flexible protrusions extending inward slightly as to create an opening having a size that is slightly less than said diameter, through which to receive coins to be contained by the holder and to dispense the same, said upper tabs and said opposing walls defining an aperture portion for each said cavity through which coins carried thereby maybe viewed and manipulated; said cavities being adapted to dependably retain coins held in an array and in a respective flat manner whether the coins are in a new or worn condition.

2. A coin holder as defined in claim 1, wherein said holder is fabricated from a substantially rigid plastic material.

3. A coin holder as set forth in claim 1, wherein said array is a longitudinal array.

4. A coin holder as set forth in claim 1, wherein said obstruction is centrally located on said holder.

5. A coin holder as set forth in claim 1, wherein said coins are a pair of coins.

6. A coin holder as set forth in claim 1, wherein said rigid body is a flat body.

* * * * *